US007886730B2

(12) United States Patent
Sheng

(10) Patent No.: US 7,886,730 B2
(45) Date of Patent: Feb. 15, 2011

(54) APPARATUS FOR DETECTING THE POSITION OF THE PAINTBALL OF A PAINTBALL GUN

(76) Inventor: Chih-Sheng Sheng, No. 100, Tzu Chiang W. Road, Kweishan Hsiang, Taoyuan County 333 (TW)

( * ) Notice: Subject to any disclaimer, the term of this patent is extended or adjusted under 35 U.S.C. 154(b) by 227 days.

(21) Appl. No.: 12/318,631

(22) Filed: Jan. 5, 2009

(65) Prior Publication Data

US 2010/0170493 A1 Jul. 8, 2010

(51) Int. Cl.
*F41B 11/00* (2006.01)

(52) U.S. Cl. ..... 124/71; 124/32

(58) Field of Classification Search ..... 124/32, 124/71–77

See application file for complete search history.

(56) References Cited

U.S. PATENT DOCUMENTS

| | | | | |
|---|---|---|---|---|
| 6,966,313 | B1 * | 11/2005 | Yokota et al. | 124/32 |
| 7,017,569 | B2 * | 3/2006 | Jong | 124/52 |
| 7,150,276 | B1 * | 12/2006 | Rice | 124/73 |
| 2003/0131834 | A1 * | 7/2003 | Rice et al. | 124/32 |
| 2006/0005825 | A1 * | 1/2006 | Monks | 124/77 |
| 2006/0102161 | A1 * | 5/2006 | Wood | 124/41.1 |
| 2007/0131209 | A1 * | 6/2007 | Campo et al. | 124/56 |
| 2008/0078370 | A1 * | 4/2008 | Kaakkola et al. | 124/73 |
| 2008/0127957 | A1 * | 6/2008 | Campo | 124/32 |
| 2009/0095271 | A1 * | 4/2009 | Jones | 124/77 |

* cited by examiner

*Primary Examiner*—Troy Chambers
(74) *Attorney, Agent, or Firm*—Rosenberg, Klein & Lee

(57) ABSTRACT

An apparatus for detecting the position of the paintball of a paintball gun includes an induction plate responsive to electrostatic capacity. The induction plate is positioned at a corresponding side of the ball-falling tube within the firing area of the gun barrel, and the induction plate consists of a conductive terminal piece and equivalent electrostatic capacity. An insulated body is interposed between the terminal piece and the gun barrel. Besides, an electrostatic capacity detection circuit is electrically coupled to the induction plate for detecting the change of the electrostatic capacity of the induction plate. Moreover, the signal of the change of the electrostatic capacity is transmitted to the paintball-firing circuit for a reliable detection if the paintball accurately reaches the firing area such that the push tube may be actuated in accordance with this information. In this way, an accurate detection is ensured without being disturbed by other light sources. Moreover, an undesired firing action is avoided when the paintball is still not fed in position. In addition, it is not required to clean up the firing area. Furthermore, a low power consumption is achieved.

8 Claims, 9 Drawing Sheets

APPARATUS FOR DETECTING THE POSITION OF THE PAINTBALL OF A PAINTBALL GUN

BACKGROUND OF THE INVENTION

1. Field of the Invention

The invention relates to an apparatus for detecting the position of the paintball of a paintball gun, and more particularly to an electrostatic capacity detection apparatus that is positioned in the firing area. Unlike the conventional infrared transmitting/receiving way to create the reflection or interruption state, the feature of the electrification of the paintball is utilized for detecting the fact if the paintball completely reaches the firing area. In this way, an immediate and accurate detection is ensured.

2. Description of the Related Art

In recent years, paintball gun has become a popular outdoor recreational sport. As shown in FIGS. 1 and 2, a paintball gun includes a paintball-feeding unit 12 at the top of the gun barrel 11. Several paintballs are accommodated within the gun barrel 12. A high-pressure tank 15 is attached to the bottom of the gun handle 13. A firing element will be actuated by the gas released from the high-pressure tank 15 when a trigger is pressed by the finger such that the paintball is discharged.

The gun barrel 12 is filled with several paintballs 20. As shown in FIGS. 3 and 4, the paintball 20 passes through a guide tube 16 and enters into a firing area 17. At that time, the paintball 20 will be detected by sensors 18 at both side of the firing area 17 to determine if it is fed in place. Then, the signal will be transmitted via a lead 19 to a circuit board (not shown) within the gun handle 13 for controlling the firing action.

However, the sensors 18 have to be installed at both side walls of the firing area 17 such that an infrared transmitting/receiving action takes place to determine if the paintball is located in the firing area 17. The sensing way can be divided into reflective and blocking type according to the light path. The reflective type easily causes a false determination due to the color of the paintball 20. For example, the black paintball 20 has a small light-reflective amount such that the detection circuit may make a false determination that no paintball 20 is present since it does not obtain sufficient reflective light. As a result, most of the paintball guns employ the blocking type sensors. However, the blocking type sensors still have the following drawbacks in use:

1. The interference of other light sources: The sun daylight and the artificial light source include a spectrum of infrared, visible light, and ultraviolet. If the other light sources fall on the optical receiver and if the light intensity is so great that the optical receiver does not work due to the light saturation, a false determination may take place since the detection circuit is not properly responsive to the light falling on the optical receiver. Particularly, this often happens to the transparent or translucent paintball-feeding units 12. The other light sources can pass through the paintball-feeding unit 12 and reach the firing area. The light-blocking type paintball detection circuit may make a false determination if the light is strong enough. Originally, it is a good design that the number of the paintballs 20 is visible through the transparent or translucent paintball-feeding units. The user will be disappointed when the light-blocking type paintball detection circuit does not work due to the light disturbance. In addition, the light or paintball detection circuit may also make a false determination when the gun barrel of the paintball gun is directed to the light source and the light enters from the gun barrel directly into the firing area (if the light is strong enough).
2. The light transmitter and receiver are vulnerable to the contamination of the contents of the paintball such that a function failure takes place. The light-blocking type paintball detection circuit must be received within a cavity laterally extended (while the paintball 20 is discharged in longitudinal direction). The light transmitter and receiver are accommodated within the cavity. The light transmitter and receiver are always provided with openings at the detection end thereof. The paint filling of the paintball will fill the openings, thereby blocking the light transmitter and receiver and leading to a function failure when the paintball 20 is unfortunately broken. Even, the paint filling of the paintball will flow along the openings to the circuit behind the light transmitter and receiver. The paint filling of the paintball is conductive so that the light-blocking type paintball detection circuit will be affected. It is probable to lead to a function failure of the light-blocking type paintball detection circuit. The paint filling of the paintball is corrosive. The paintball gun will be damaged when the paint filling flowing along the openings to enter into the paintball gun is not cleaned up in time. However, the paint filling is not easily cleaned up at once due to the shape of the openings. It is not possible to immediately clean it up at the playing field. The paintball is more easily broken when the paintball gun has a malfunctioned paintball detection circuit. The push tube may get stuck by the broken shell of the paintball, thereby causing a problematic discharge. Moreover, the fired paintball may have an instable track in the air when the previously broken paintball leaves the paint filling on the new discharged paintball 20 (even without getting stuck). A light shade may be mounted to resolve the above-mentioned problem. The light travel direction may be unreasonable due to the shape and the angle, thereby considerably reducing the accuracy in determination. Besides, a disturbance by the external light source may occur.
3. The light-blocking type paintball detection circuit of the light transmitter and receiver is employed to detect the lower part of the paintball. The paintball will be sensed when it falls as low as possible. In this way, the paintball may be discharged when fed in place. Otherwise, the paintball 20 may get stuck or broken when fired if it falls only to a half position. Theoretically, the optimal detection point is the lowest point of the paintball. In fact, there are still gaps in the firing area so that the paintball may roll therein. In order to enable the paintball to block the light, the detection point must be raised so that the lowest point can not be detected.

Therefore, the conventional way to detect the paintball requires further improvement.

SUMMARY OF THE INVENTION

An object of the invention is to provide an apparatus for detecting the position of the paintball of a paintball gun wherein the feature of the electrification of the paintball is utilized such that the position of the paintball is detected by the electrostatic capacity. In this way, the disturbance by other light sources may be avoided.

Another object of the invention is to provide an apparatus for detecting the position of the paintball of a paintball gun wherein the detection is conducted by use of the electrostatic capacity without being contaminated or blocked by the paint filling of the paintball. The firing area may be cleaned up once the paintball is fired. The fighting power can be recovered at once. Moreover, it is not required to clean up the inside of the paintball gun after the game.

A further object of the invention is to provide an apparatus for detecting the position of the paintball of a paintball gun wherein the closer to the induction plate the paintball is positioned, the more accurate is the detection. Besides, the induction plate is large enough so that the paintball won't roll within the firing area. As a result, the detection point can be lowered to a lowest point for an improved detection accuracy.

Still another object of the invention is to provide an apparatus for detecting the position of the paintball of a paintball gun wherein the electrostatic capacity detection circuit has a low power consumption. In other words, it consumes only a few μA). It is very important for the paintball gun powered by batteries. The service life of the batteries can be prolonged. Moreover, it is not required to replace the batteries frequently. Thus, an environment protection function may be fulfilled.

In order to achieve the above-mentioned object, an apparatus for detecting the position of the paintball of a paintball gun in accordance with the invention includes the following features. An induction plate responsive to electrostatic capacity is positioned at a corresponding side of the ball-falling tube within the firing area of the gun barrel, and the induction plate consists of a conductive terminal piece and equivalent electrostatic capacity, and an insulated body is interposed between the terminal piece and the gun barrel. An electrostatic capacity detection circuit is electrically coupled to the induction plate for detecting the change of the electrostatic capacity of the induction plate; moreover, the signal of the change of the electrostatic capacity is transmitted to the paintball-firing circuit for a reliable detection if the paintball accurately reaches the firing area such that the push tube may be actuated in accordance with this information.

BRIEF DESCRIPTION OF THE DRAWINGS

The accomplishment of this and other objects of the invention will become apparent from the following descriptions and its accompanying figures of which.

DETAILED DESCRIPTION OF THE PREFERRED EMBODIMENT

Figure 1:
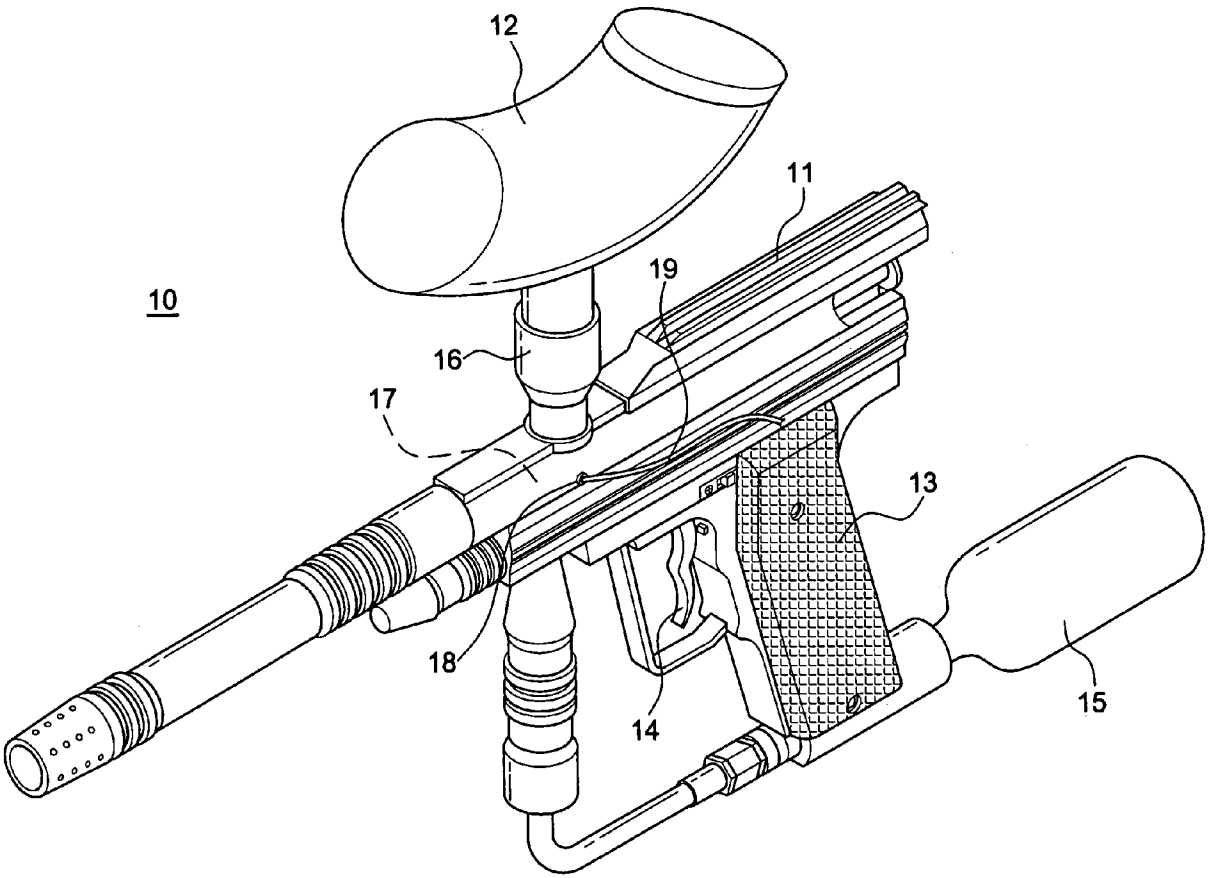
FIG.1 PRIOR ART
FIG. 1 is a perspective view of a conventional paintball gun.
Figure 2:
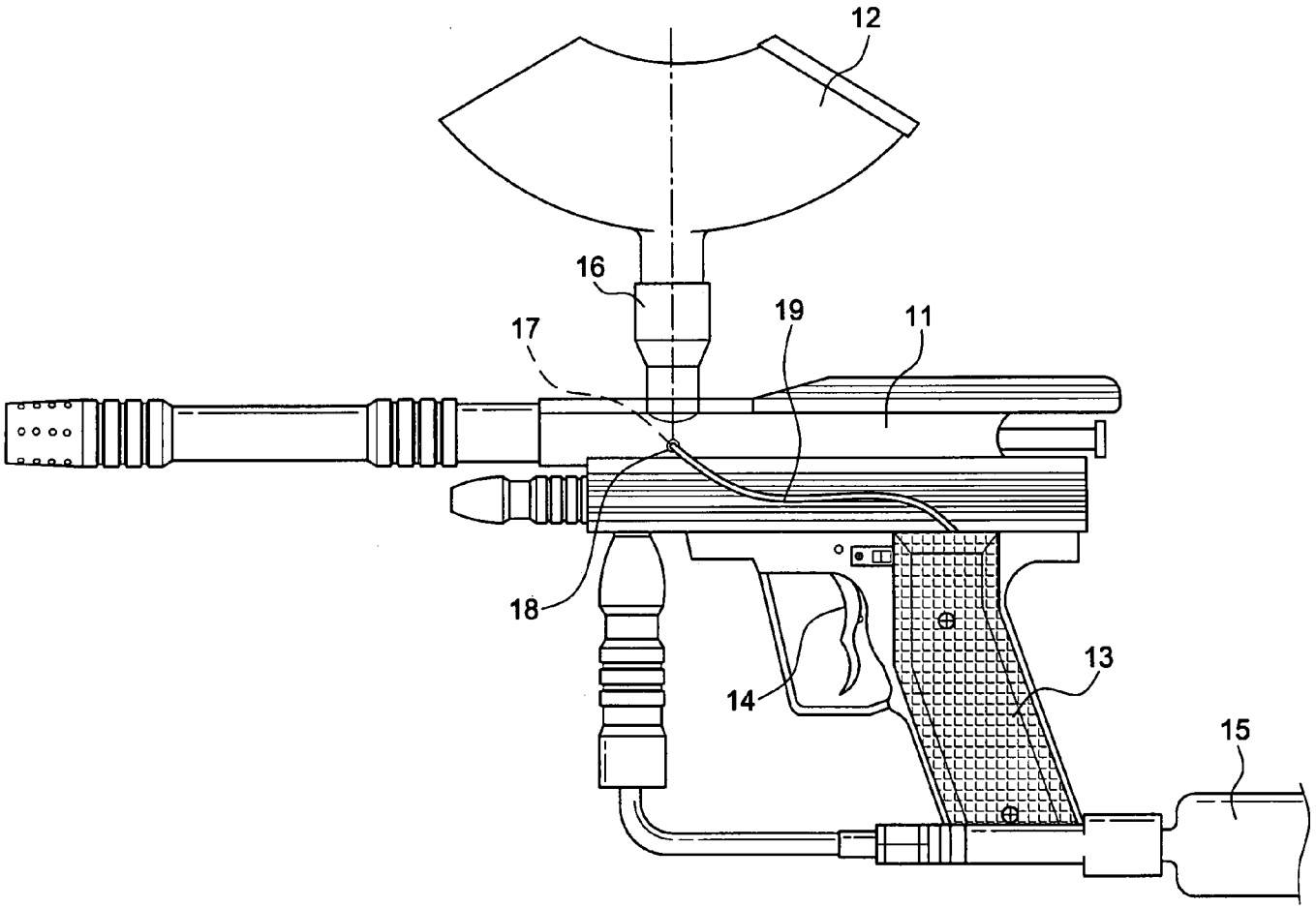
FIG.2 PRIOR ART
FIG. 2 is a side view of the conventional paintball gun.
Figure 3:
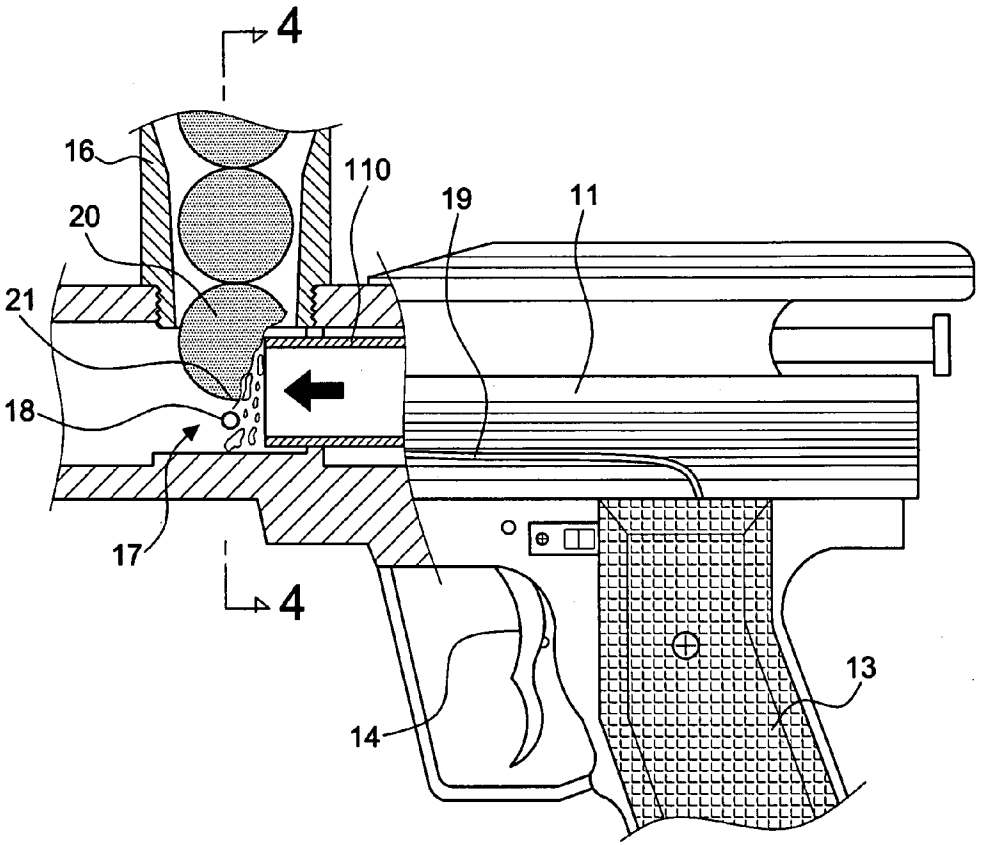
FIG.3 PRIOR ART
FIG. 3 is a cutaway view of the conventional paintball gun.
Figure 4:
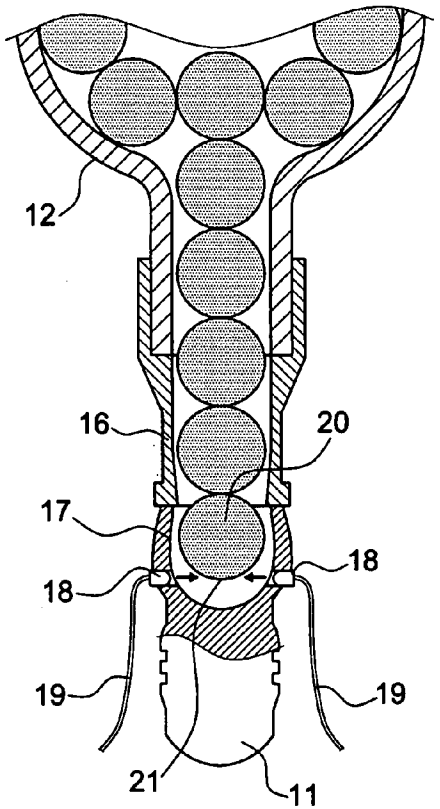
FIG.4 PRIOR ART
FIG. 4 is a cutaway view taken along the line 4-4 in FIG. 3.
Figure 5:
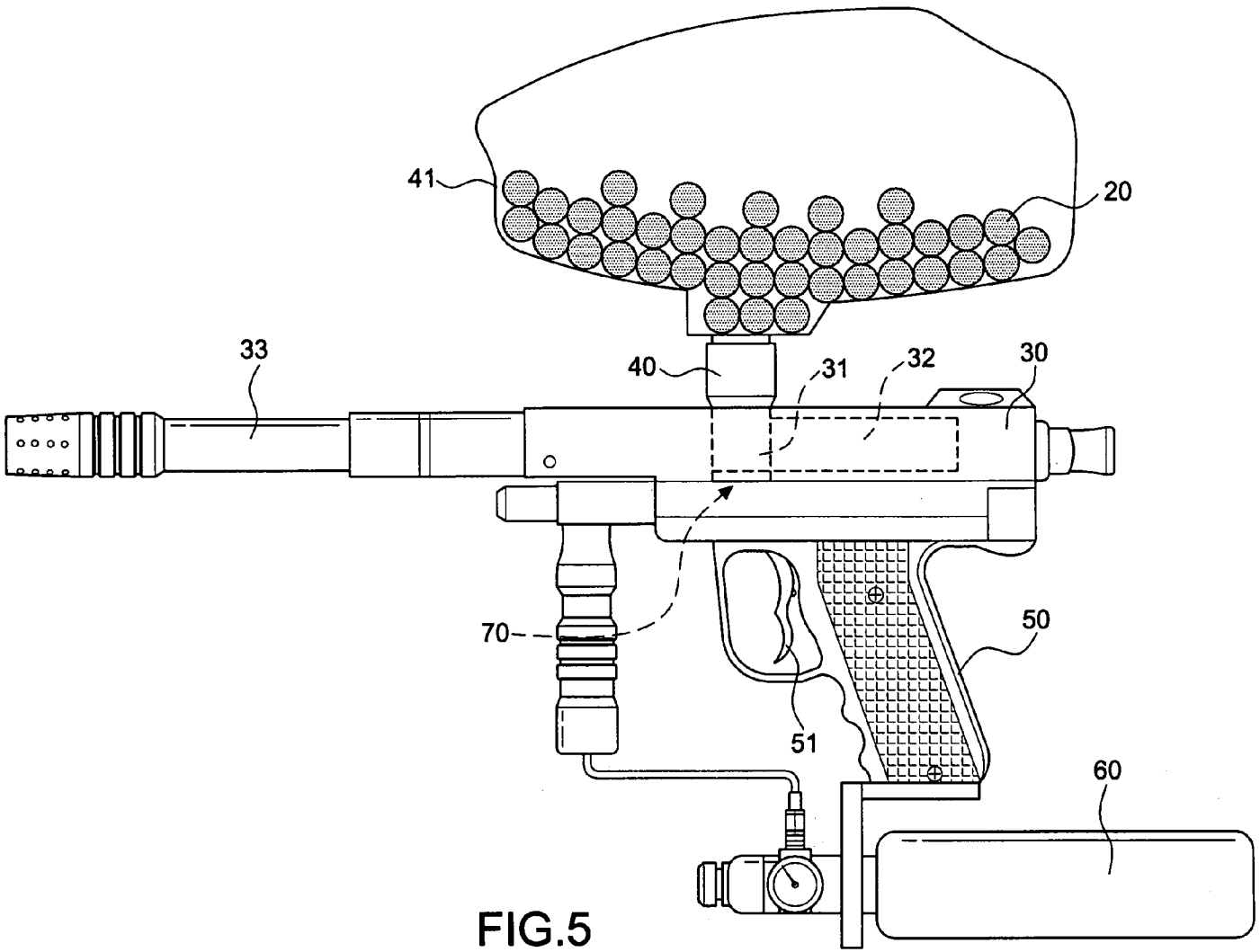
FIG. 5 is a perspective view of a first embodiment of the invention.
Figure 6:
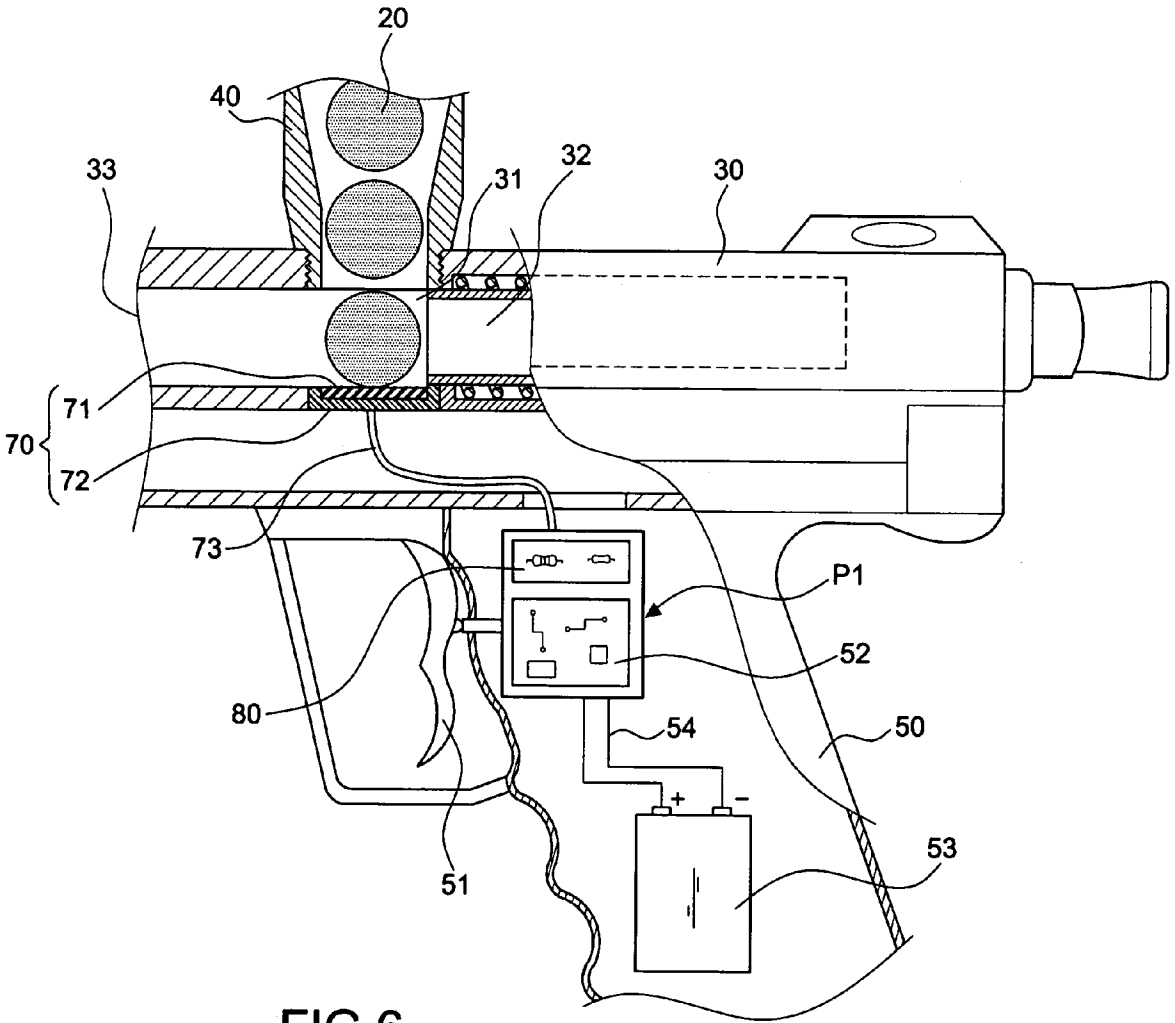
FIG. 6 is a cutaway view of the main structure of the first embodiment of the invention.

First of all, referring to FIGS. 5 and 6, a first embodiment of an apparatus for detecting the position of the paintball of a paintball gun in accordance with the invention includes a gun barrel 30, a ball-falling tube 40, a gun handle 50, and a high-pressure tank 60.

The gun barrel 30 internally includes a push tube 32 for firing the paintball 20 from a firing area 31 through a gun tube 33 outward.

The ball-falling tube 40 is positioned at the periphery of the firing area 31. According to the embodiment, the ball-falling tube 40 is disposed at the top thereof, but should not be limited thereto. There are many other ball-falling tubes 40 that are positioned at the right side of the firing area 31 for preventing the sight line from being blocked. The ball-falling tube 40 is used for the insertion of a paintball-feeding unit 41 such that the paintballs 20 therewithin in the way of freefall or by means of a paintball-pushing unit (not shown) are delivered one after another to the firing area 31.

The gun handle 50 is positioned at the bottom of the gun barrel 30. A trigger 51 is disposed at the front side thereof. As shown in FIG. 6, the trigger 51 is electrically connected to a paintball-firing circuit 52 for controlling the action of the push tube 32. Moreover, the paintball-firing circuit 52 is coupled over a lead 54 to a battery 53 for supplying power required by the paintball-firing circuit 52. According to the embodiment, the paintball-firing circuit 52 is disposed on a circuit board P1 within the gun handle 50, but should not be limited thereto.

The high-pressure tank 60 is attached to the bottom of the gun barrel 30 for supplying the power required by the push tube 32.

The above-mentioned components have been disclosed in U.S. Pat. Nos. 6,601,780B1, 6,925,997B2 and Pub. No: US2007/0119988A1 so that no further descriptions thereto are given hereinafter.

Figure 7:
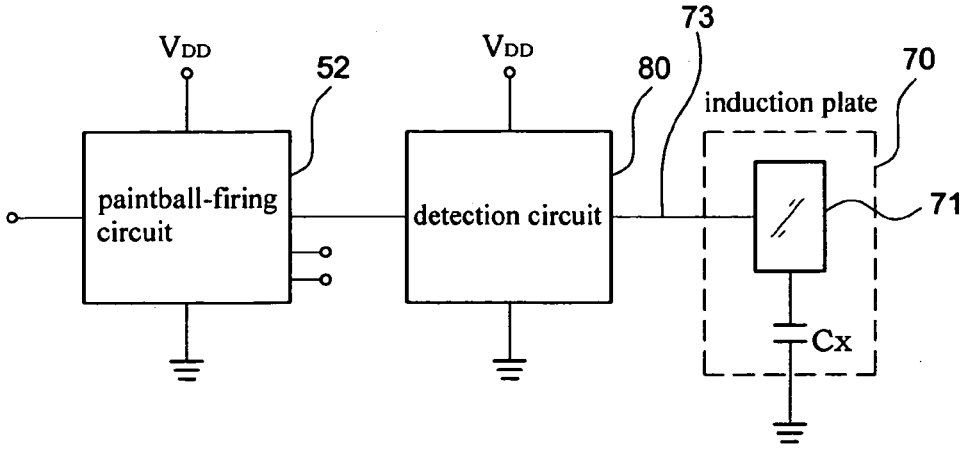
FIG. 7 is a block diagram of the circuit arrangement of the first embodiment of the invention.

As shown in FIGS. 6 and 7, an induction plate 70 responsive to electrostatic capacity is positioned at a corresponding side of the ball-falling tube 40 within the firing area 31 of the gun barrel. The induction plate 70 consists of a conductive terminal piece 71 and equivalent electrostatic capacity Cx. An insulated body 72 is interposed between the terminal piece 71 and the gun barrel 30. The equivalent electrostatic capacity Cx refers to the detection capacity when the paintball 20 approaches to the induction plate 70. Moreover, the induction plate 70 must be positioned opposite to the ball-falling tube 40. In other word, the induction plate 70 must be disposed at the bottom of the firing area 31 if the ball-falling tube 40 is mounted at the top of the firing area 31. In other word, the induction plate 70 must be disposed at the left side of the firing area 31 if the ball-falling tube 40 is mounted at the right side of the firing area 31. The paintball 20 contains liquid therein so that it has the electrified property. Therefore, the equivalent electrostatic capacity Cx on the induction plate 70 will be gradually increased when the paintball 20 falls from the ball-falling tube 40 in the firing area 31 and approaches to the induction plate 70. To the contrary, the equivalent electrostatic capacity Cx on the induction plate 70 will be decreased when the paintball 20 moves away from the induction plate 70. In this way, the distance of the paintball 20 from the induction plate 70 is measured.

The induction plate 70 having electrostatic capacity is formed in proper dimensions by conductive material, preferably by metal material for a detection circuit 80 to detect the change of the increasing and decreasing electrostatic capacity responsive to the movement of the paintball 20 toward and away from the induction plate 70. The dimensions of the induction plate 70 are selected under the condition that the induction plate 70 can be installed within the firing area 31 and the change of the electrostatic capacity may be detected.

The form of the induction plate 70 is not limited. However, the periphery of the induction plate 70 must be sufficiently enclosed by the insulated body 72 for a reliable separation from the other components such as gun barrel 30, etc. In this way, an accurate measurement of the change of the electrostatic capacity is ensured. According to the embodiment, the terminal piece 71 is enclosed by the insulated material. However, the arrangement of the insulated body 72 may be adjusted according to the structural feature of the firing area 31 or the gun barrel 30.

Moreover, the change of the electrostatic capacity detected by the induction plate 70 will be transmitted to the detection circuit 80 via a transmission wire 73. The transmission wire 73 is capable of detecting the change of the electrostatic capacity as well. Therefore, the length of the transmission wire 73 has to be reduced as much as possible. Preferably, the transmission wire 73 is a coaxial cable.

According to the embodiment shown in FIGS. 6 and 7, the electrostatic capacity detection circuit 80 is electrically coupled to the induction plate 70 via the transmission wire 73 for detecting the change of the electrostatic capacity of the induction plate 70. Moreover, the signal of the change of the electrostatic capacity is transmitted to the paintball-firing circuit 52 for a reliable detection if the paintball 20 accurately reaches the firing area 31. As a result, the push tube 32 may be actuated in accordance with this information.

Figure 8:
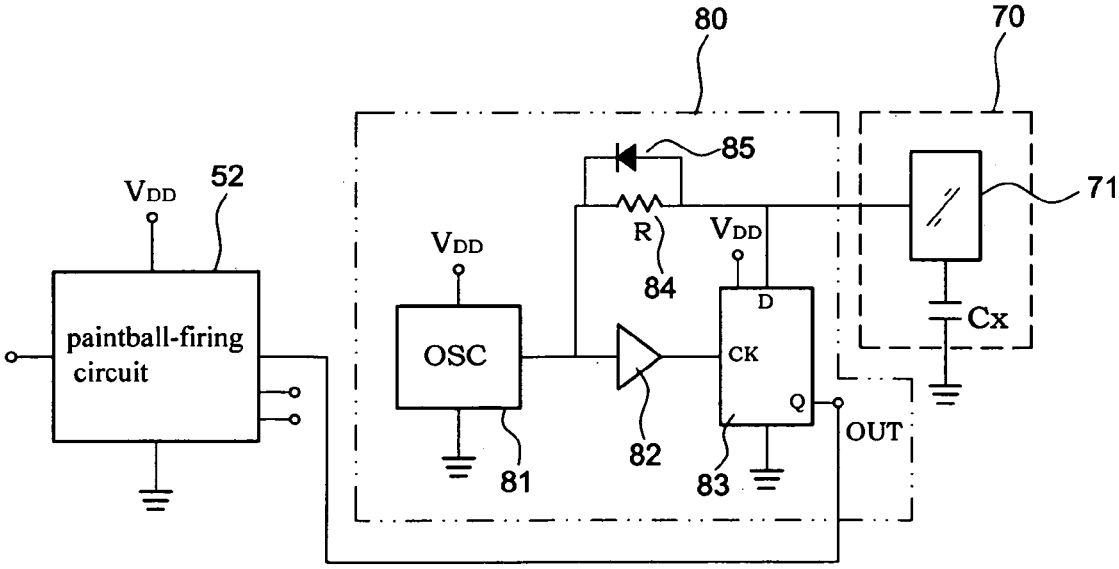
FIG. 8 is a circuit diagram of the first embodiment of the invention.

The electrostatic capacity detection circuit 80 may be a conventional integrated circuit such as TTP223, IQS123, etc. Alternatively, the electrostatic capacity detection circuit 80 may be a frequency detector. According to the embodiment shown in FIG. 8, the electrostatic capacity detection circuit 80 consists of an oscillator 81, a buffer 82, a flip-flop 83, a resistance 84, and a diode 85. The induction plate 70 detects the change of the electrostatic capacity such that the time will be changed when the signal of the oscillator 81 is transmitted to the input foot D. In this way, the signal reaches the input pin D earlier or later than it reaches the signal foot CK. As a result, the output foot Q obtains different output values that stand for the fact whether the paintball 20 reaches the prearranged position of the firing area 31.

The electrostatic capacity detection circuit 80 can be a separate circuit. Alternatively, the electrostatic capacity detection circuit 80 and the paintball-firing circuit 52 can be integrated in one circuit. The applicable embodiment of the induction plate 70 and the electrostatic capacity detection circuit 80 is detailed as follows:

According to the above-mentioned first embodiment, the electrostatic capacity detection circuit 80 and the paintball-firing circuit 52 are positioned within the gun handle 50. And they can be individually disposed on different circuit boards or disposed on the same circuit board P1.

Figure 9:
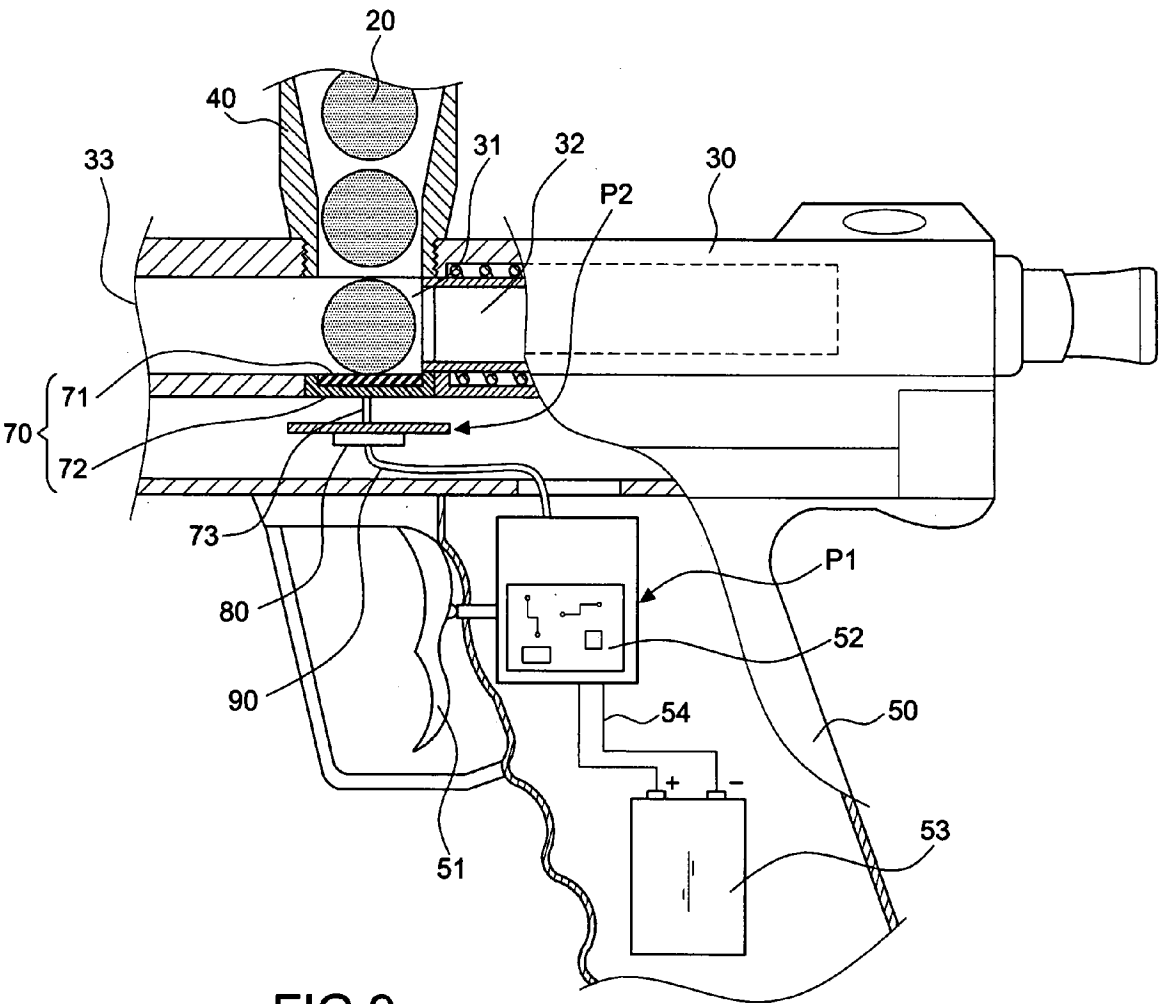
FIG. 9 is a cutaway view of the main structure of a second embodiment of the invention.

FIG. 9 shows a second embodiment of the invention. The components the same to the previous embodiment are marked with the same reference sign. The difference lies in that the electrostatic capacity detection circuit 80 is disposed close to the induction plate 70 within the gun barrel 30 and coupled via an electric wire to the paintball-firing circuit 52 within the gun handle 50.

Figure 10:
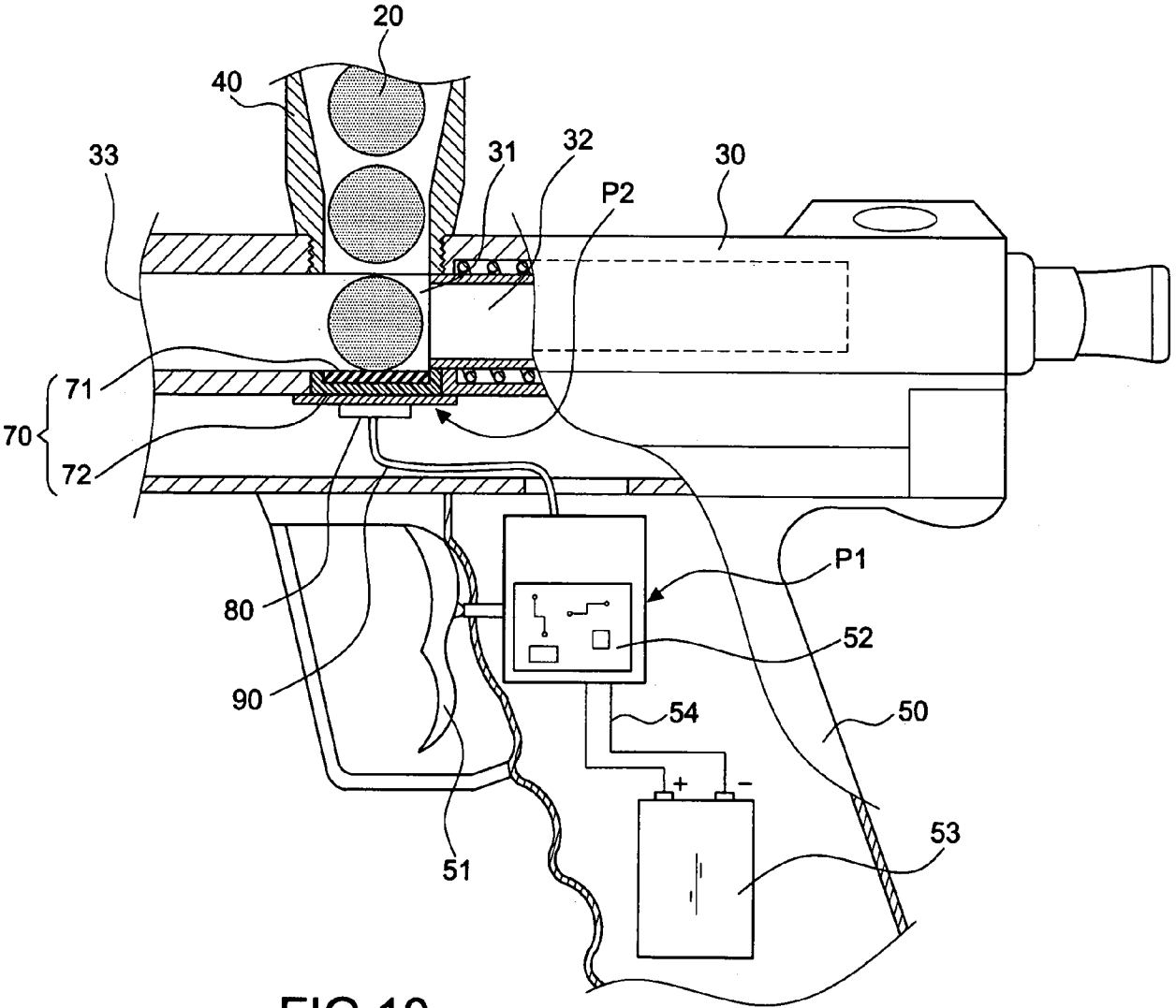
FIG. 10 is a cutaway view of the main structure of a third embodiment of the invention.

FIG. 10 shows a third embodiment of the invention. The induction plate 70 and the electrostatic capacity detection circuit 80 are both positioned on the same circuit board P2 within the gun barrel 30. In other words, the induction plate 70 can be electrically coupled to the circuit board P2 by use of the surface-mounting technology. In this way, the transmission wire 73 is not required and can be directly replaced by the copper foil wire. Of course, a terminal piece 71 can be directly formed by the copper foil on the circuit board P2 and then enclosed by the insulated body 72.

Figure 11:
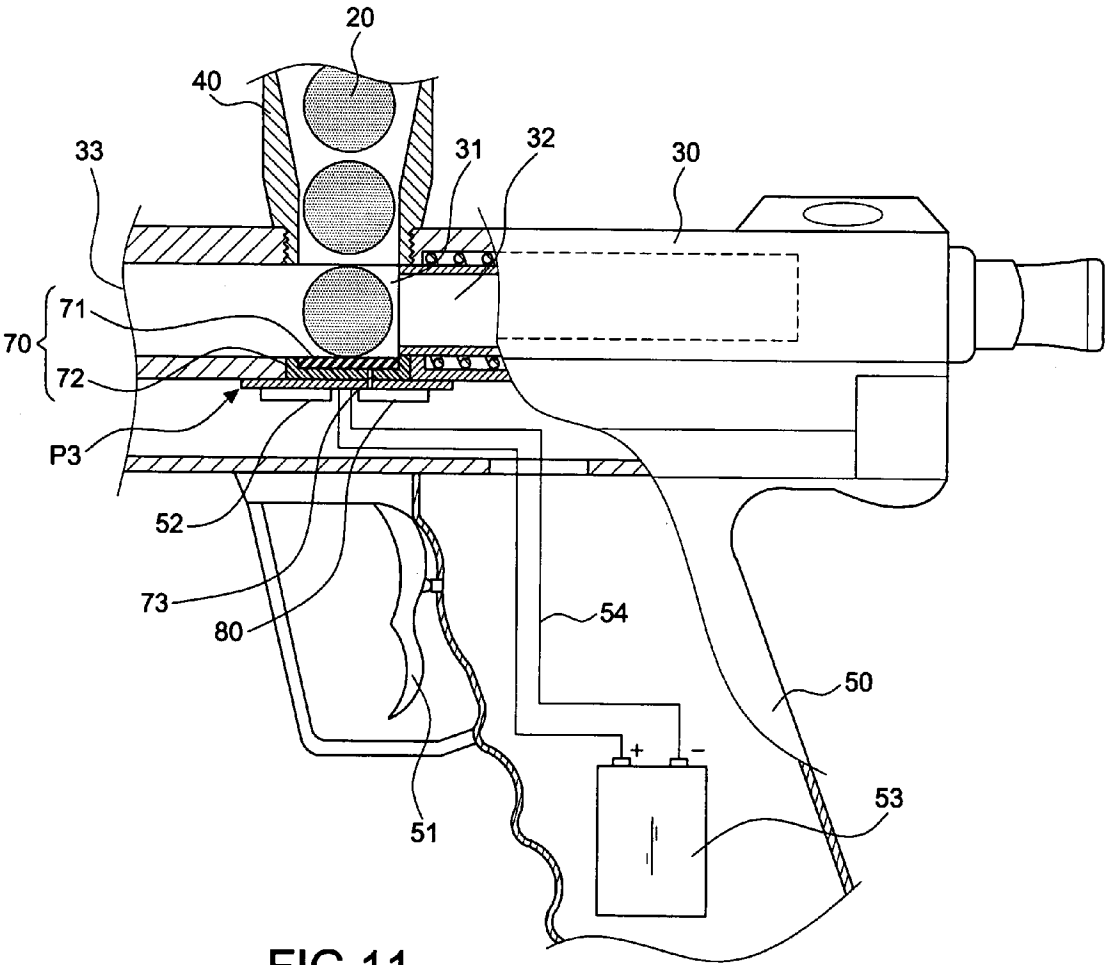
FIG. 11 is a cutaway view of the main structure of a third embodiment of the invention.

FIG. 11 shows a fourth embodiment of the invention. The induction plate 70, the transmission wire 73, the electrostatic capacity detection circuit 80 and the paintball-firing circuit 52 are positioned on the same circuit board P3 and disposed perpendicularly to the paintball-feeding direction within the gun barrel 30. In this way, it is not required to externally connect the transmission wire 73 and the electric wire 90, but a lead 54 is required for an electric connection with the battery 53 within the gun handle 50 for supplying power to the circuit board P3. The battery 53 can also be externally coupled in addition to the arrangement within the gun handle 50.

Based on the above-mentioned features, the apparatus in accordance with the invention may eliminate the drawbacks of the conventional way by optically detecting the paintball. According the invention, the position of paintball is detected by the change of the electrostatic capacity when the paintball approaches to the induction plate 70. As a result, the response won't be influenced by other lights. Moreover, the detection with the electrostatic capacity has the advantage of easy cleaning, high accuracy, and low power consumption.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An apparatus for detecting the position of the paintball of a paintball gun, comprising:

a) a gun barrel internally having a push tube for firing the paintball from a firing area through a gun tube outward;

b) a ball-falling tube positioned at one side of the firing area for the insertion of a paintball-feeding unit such that the paintballs in the paintball-feeding unit are delivered one after another to the firing area;

c) a gun handle positioned at the bottom of the gun barrel, a trigger being disposed at the front side thereof, the trigger being electrically connected to a paintball-firing circuit for controlling the action of the push, the paintball-firing circuit being coupled to a battery for supplying power required by the paintball-firing circuit; and d) a high-pressure tank attached to the bottom of the gun barrel for supplying the power required by the push tube;

wherein an induction plate responsive to electrostatic capacity is positioned at a corresponding side of the ball-falling tube within the firing area of the gun barrel, and the induction plate consists of a conductive terminal piece and equivalent electrostatic capacity, and an insulated body is interposed between the terminal piece and the gun barrel; and wherein an electrostatic capacity detection circuit is electrically coupled to the induction plate for detecting the change of the electrostatic capacity of the induction plate; moreover, the signal of the change of the electrostatic capacity is transmitted to the paintball-firing circuit for a reliable detection if the paintball accurately reaches the firing area such that the push tube may be actuated in accordance with this information.

2. The apparatus for detecting the position of the paintball of a paintball gun as recited in claim 1 wherein the induction plate is disposed at the bottom of the firing area while the electrostatic capacity detection circuit and the paintball-firing circuit are positioned within the gun handle, and wherein the induction plate is coupled to the electrostatic capacity detection circuit via a transmission wire.

3. The apparatus for detecting the position of the paintball of a paintball gun as recited in claim 2 wherein the transmission wire is a coaxial cable.

4. The apparatus for detecting the position of the paintball of a paintball gun as recited in claim 2 wherein the electrostatic capacity detection circuit and the paintball-firing circuit are both disposed on the same circuit board P1.

5. The apparatus for detecting the position of the paintball of a paintball gun as recited in claim 1 wherein the induction plate is disposed at the bottom of the firing area while the electrostatic capacity detection circuit are positioned within the gun handle, and wherein the induction plate is coupled to the electrostatic capacity detection circuit via a transmission wire, and wherein the electrostatic capacity detection circuit is coupled to the paintball-firing circuit within the gun handle via an electric wire.

6. The apparatus for detecting the position of the paintball of a paintball gun as recited in claim 5 wherein the induction plate and the electrostatic capacity detection circuit are both disposed on the same circuit board P2.

7. The apparatus for detecting the position of the paintball of a paintball gun as recited in claim 1 wherein the induction plate is disposed at the bottom of the firing area, and wherein the induction plate, the electrostatic capacity detection circuit, and the paintball-firing circuit are positioned on the same circuit board P3 within the gun barrel.

8. The apparatus for detecting the position of the paintball of a paintball gun as recited in claim 7 wherein the circuit board P3 is electrically coupled to a battery within the gun handle via a lead.

* * * * *